US009265367B2

(12) United States Patent
Arnott

(10) Patent No.: US 9,265,367 B2
(45) Date of Patent: Feb. 23, 2016

(54) SURROUND FOR PLANTS, TREES, AND POST

(71) Applicant: Mackenzie Rae Arnott, Chemainus (CA)

(72) Inventor: Mackenzie Rae Arnott, Chemainus (CA)

( * ) Notice: Subject to any disclaimer, the term of this patent is extended or adjusted under 35 U.S.C. 154(b) by 0 days.

(21) Appl. No.: 14/078,617

(22) Filed: Nov. 13, 2013

(65) Prior Publication Data

US 2014/0141183 A1 May 22, 2014

Related U.S. Application Data

(60) Provisional application No. 61/728,582, filed on Nov. 20, 2012.

(51) Int. Cl.
*A47G 7/08* (2006.01)

(52) U.S. Cl.
CPC ..... *A47G 7/08* (2013.01)

(58) Field of Classification Search
CPC ..... A63F 9/10; B44C 3/12; A47G 7/08; A01G 9/02; A01G 13/10; A01G 1/007; A01G 27/006; A01G 31/02; A01G 9/00; A01G 9/025; A01G 9/1066; A01G 9/1423; A01G 9/246
USPC ..... 428/33, 19
See application file for complete search history.

(56) References Cited

U.S. PATENT DOCUMENTS

| | | | | |
|---|---|---|---|---|
| 1,499,473 | A | 7/1924 | Price | |
| 4,216,622 | A * | 8/1980 | Hollenbach et al. | 47/71 |
| 4,847,741 | A | 7/1989 | Boettinger | |
| D386,114 | S | 11/1997 | Carson | |
| D416,214 | S | 11/1999 | Conner | |
| 6,269,589 | B1 | 8/2001 | Bouler | |
| 6,381,902 | B1 * | 5/2002 | Batshon | 47/86 |
| 6,539,665 | B1 | 4/2003 | Llona | |
| D480,986 | S | 10/2003 | Taylor | |
| 2004/0200143 | A1 * | 10/2004 | Stanley | 47/44 |
| 2007/0227068 | A1 | 10/2007 | Cataldi | |
| 2011/0083364 | A1 | 4/2011 | Hilbert | |
| 2012/0131851 | A1 | 5/2012 | Bell | |
| 2012/0233917 | A1 * | 9/2012 | Sovey-Strah | 47/66.3 |

FOREIGN PATENT DOCUMENTS

| | | |
|---|---|---|
| WO | WO0135722 | 5/2001 |

* cited by examiner

*Primary Examiner* — Gwendolyn Blackwell
*Assistant Examiner* — Kevin Ortman, Jr.
(74) *Attorney, Agent, or Firm* — Adrian D. Battison; Ade & Company Inc.

(57) ABSTRACT

An ornamental surround is positioned around the base of an upright structure, such as a plant, shrub, tree, post, or pole. When assembled, the ornamental surround has the outward appearance of a plant pot or planter. Further provided is a combination comprising the ornamental surround, a kit comprising the ornamental surround, and a method of installing the ornamental surround around the base of an upright structure.

4 Claims, 5 Drawing Sheets

SURROUND FOR PLANTS, TREES, AND POST

This application claims the benefit under 35 USC 119(e) of Provisional application 61/728,582 filed Nov. 20 2012.

This disclosure relates to the field of ornamental surrounds that can be positioned around or against the base of upright structures such as plants, trees, fences, poles, and posts to enhance their visual appeal and particularly to ornamental surrounds that resemble plant pots or planters.

BACKGROUND OF THE INVENTION

The base of upright structures such as trees and posts is frequently plain and often unsightly. There is also a desire for residential or commercial properties to have a clean and finished look. One way to enhance the visual appearance of a property is to add potted plants. However, potted plants can be expensive and require ongoing maintenance; for example watering, fertilizing, and transplanting. In-ground plants, for example trees and shrubs, are easier to maintain than potted plants but do not have the tidy appearance of a potted plant. Further, the base of in-ground plants may be subject to damage from a variety of sources such as animals, insects, and yard maintenance equipment.

A variety of planters designed to attach to or wrap around upright objects such as posts and trees are known in the art. For example, various planters are taught in U.S. D386114, U.S. D416214, U.S. D480986, U.S. Pat. No. 1,499,473, U.S. Pat. No. 4,847,741, U.S. Pat. No. 6,269,589, U.S. Pat. No. 6,381,902, U.S. Pat. No. 6,539,665, U.S. Pat. No. 7,797,880, US2007227068, US2011083364, US2012131851, and WO0135722. All of these items are designed for use as plant pots or planters that hold potting material and plants. As mentioned previously, potted plants can be expensive, they are often seasonal, and they typically require ongoing maintenance to survive and look their best. Using plant pots or planters to enhance the look of a tree or post base brings with it expense and labour.

SUMMARY OF THE INVENTION

According to the invention there is provided an ornamental surround for improving the appearance of an upright structure by making the upright structure appear to be potted, comprising:

- at least one shell having an inner face, an outer face, an upper end, a lower end, a first edge section, and a second edge section; and
- at least one fastener joined to the first edge section of the shell;
- wherein the shell has sufficient rigidity to be self-supporting;
- wherein the fastener is arranged to fasten the edge sections of the at least one shell to form an assembled surround;
- and wherein the assembled surround has the outward appearance of a plant pot or planter.

In order to resemble the plant pot or planter, the surround preferably presents a flat base to sit on the ground and a frustoconical wall which extends upwardly and outwardly to a common peripheral top edge parallel to the base. Preferably the top edge is circular. The outer wall may be shaped to define a top collar surrounding the top edge. Other shapes of wall can be used including convex.

The invention further provides a combination comprising the ornamental surround as defined above, and an upright structure comprising a shrub, tree, post, or pole The invention further provides a kit comprising an ornamental surround as defined above together with an anchor material, an anchor member, or a wedging material The present disclosure provides an ornamental surround that can be assembled around the base of an upright structure, for example a plant, tree, pole, or post, to hide the base of the structure and provide a tidy finished look. Additionally, shells that are used to assemble the surround may be used independently through placement against a linear upright surface, such as a wall or fence, to provide the appearance of an ornamental surround protruding from the linear upright surface. The ornamental surround may provide an additional benefit of protecting the base of the upright structure from damage from sources such as animals, insects, and yard maintenance equipment.

In an embodiment, the ornamental surround of the disclosure is for improving the appearance of an upright structure by making the upright structure appear to be potted, and the ornamental surround comprises at least one shell having an inner face, an outer face, an upper end, a lower end, a first edge section, and a second edge section; and at least one fastener joined to the first edge section of the shell, wherein the shell has sufficient rigidity to be self-supporting, the fastener is arranged to fasten the edge sections of the at least one shell to form an assembled surround, and the assembled surround has the outward appearance of a plant pot or planter. In a further embodiment, the upright structure is a shrub, tree, post, or pole.

In an additional embodiment, the ornamental surround comprises at least one shell having an inner face, an outer face, an upper end, a lower end, a first edge section, and a second edge section; at least one fastener joined to the first edge section of the shell; and a lip protruding from the lower end of the inner face of the at least one shell, wherein the shell has sufficient rigidity to be self-supporting, the fastener is arranged to fasten the edge sections of the at least one shell to form an assembled surround, and the assembled surround has the outward appearance of a plant pot or planter and the lip is sufficiently narrow to allow the surround to be assembled around the base of the upright structure.

In an embodiment, the assembled surround is fillable with an anchor material and the lip is sufficiently wide to engage the anchor material, enabling the anchor material to weigh down the assembled surround and impede the surround from shifting position.

In a further embodiment the lip comprises one or more apertures arranged to allow the assembled surround to be anchored to a surface beneath the assembled surround by at least one anchoring member that is insertable through the aperture and into the surface beneath the assembled surround, thereby preventing the surround from shifting position.

In an embodiment, the surround comprises a single shell that is sufficiently resilient to allow the first and second edge sections of the shell to be spread apart to a distance that is sufficient to allow the spread apart edge sections to be passed around the sides of the base of the upright structure. In a further embodiment, the surround comprises a plurality of shells.

In an embodiment, the surround comprises a first shell and a second shell that are pivotally joined at their second edge sections. In a further embodiment, the first and second shells are pivotally joined by a material that is sufficiently resilient to allow the first edge sections of the shells to be spread apart to a distance that is sufficient to allow the spread apart first edge sections to be passed around the sides of the base of the upright structure.

In a further embodiment, the ornamental surround is in combination with an upright structure, wherein the surround is assembled around the base of the upright structure. In an additional embodiment, the upright structure is a shrub, tree, post, or pole.

In an additional embodiment, the combination comprising the ornamental surround in combination with an upright structure further comprises an anchor material, wherein the anchor material is positioned within the assembled surround such that the anchor material engages the lip of the surround and impedes the surround from shifting position.

In an additional embodiment, the combination comprising the ornamental surround in combination with an upright structure further comprises at least one anchor member, wherein the anchor member is positioned to engage both the lip of the surround and a surface beneath the assembled surround, thereby impeding the surround from shifting position.

In an additional embodiment, the combination comprising the ornamental surround in combination with an upright structure further comprises a wedging material, wherein the wedging material is positioned to engage both the inner face of the surround and the surface of the upright structure, thereby impeding the surround from shifting position.

An embodiment is a kit comprising an ornamental surround of the disclosure together with an anchor material, an anchor member, or a wedging material.

DETAILED DESCRIPTION

Figure 1A:
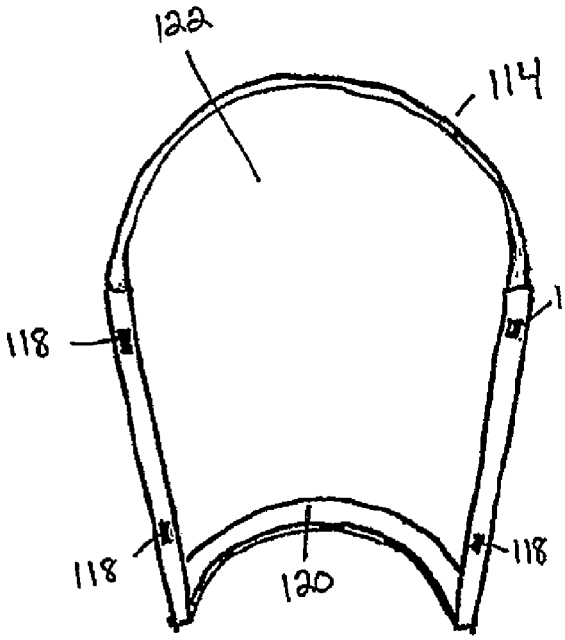
FIGS. 1A, 1B, and 1C show a perspective view of a first embodiment comprising two shells, shown in 1A and 1B, that mate together to form an assembled surround, shown in 1C.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense. Further, where considered appropriate, reference numerals may be repeated among the figures to indicate corresponding or analogous elements.

The present disclosure provides generally an ornamental surround that can be assembled around the base of an upright structure or used against the side of a linear upright structure to hide the base of the structure and provide a tidy finished look. The ornamental surround may provide an additional benefit of protecting the base of the upright structure from damage from sources such as animals, insects, and yard maintenance equipment. This ornamental surround is not intended for use as a planter for live plants, but may be filled or partially filled with an anchor material and/or a decorative material such as stone, acrylic coloured rocks, glass rocks, marbles, fake or faux rocks, bellani pod balls, natural wood chunks, bark slices, seashells, decorative spheres, wicker balls, twig balls, and/or plastic/artificial flowers and vines. Additionally, a filler material such as foam Peanuts, also known as packing peanuts or packing noodles; shredded or crumpled paper; bubble wrap; and/or Styrofoam can be used to partially fill the ornamental surround and a decorative material can be layered on top of the filler material. This reduces the amount of decorative material required and may reduce costs. The ornamental surround, once assembled, is intended to outwardly resemble a plant pot or planter and therefore may be made of any material that is used to make plant pots or planters, as will be known to a person skilled in the art. Examples of suitable materials include plastic, composite materials, wood, stone, cement, metal, rubber, silicone, clay, ceramic, and terra cotta.

Figure 1B:
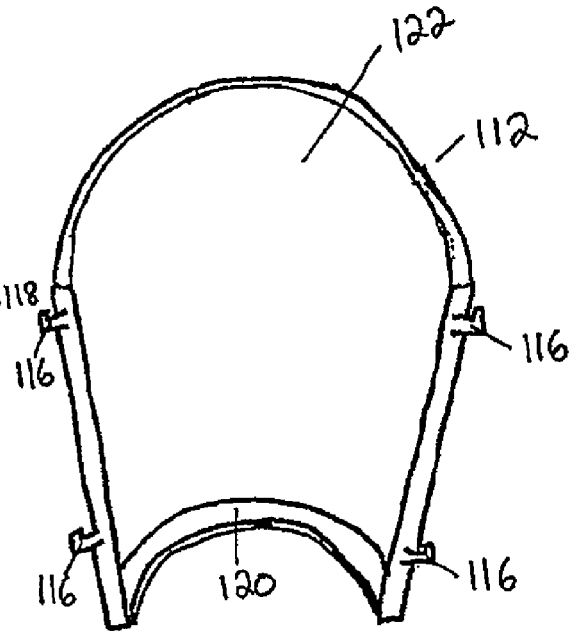
Figure 1C:
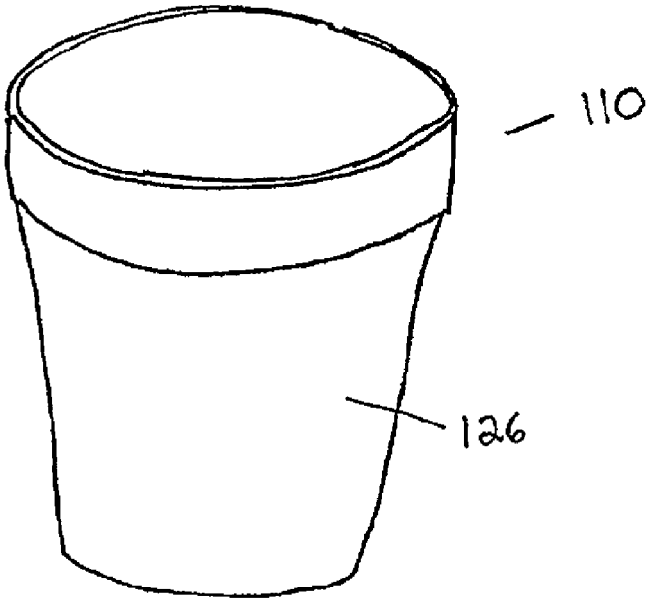

A first embodiment is depicted in FIGS. 1A, 1B, and 1C. In this embodiment, two shells 112 and 114 each comprising an inner face 122, an outer face 126, and a lip 120 protruding from the lower edge of the inner face of each shell, are mated together and held in place by catches 116 that insert into corresponding apertures 118 to form an assembled surround 110.

Figure 2A:
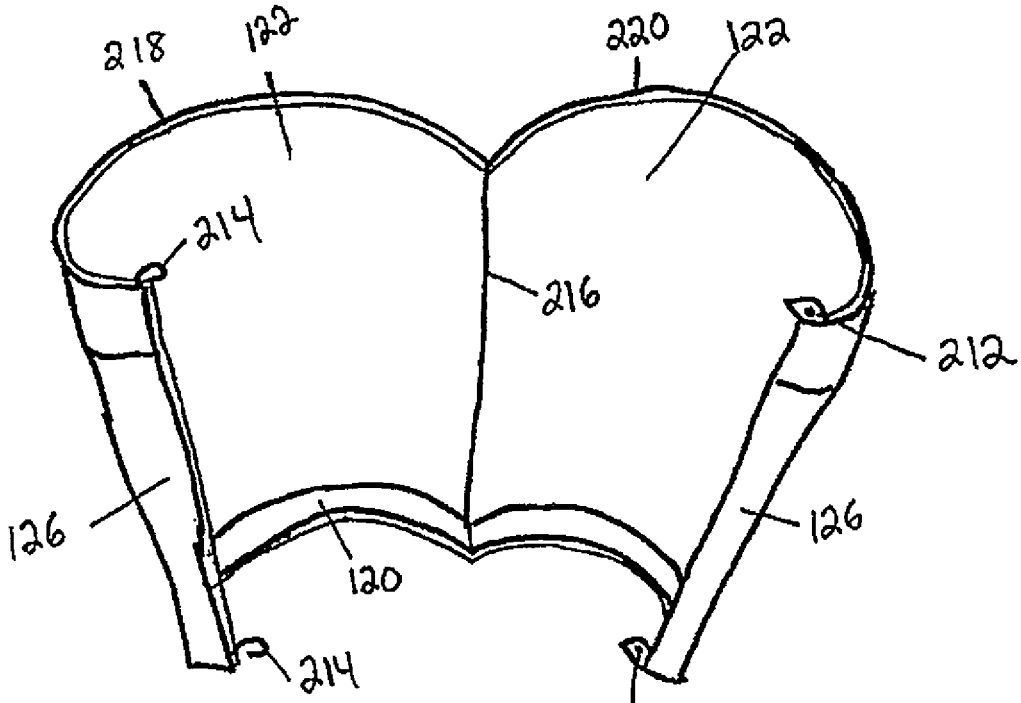
FIGS. 2A and 2B show a perspective view of a second embodiment comprising two shells joined by a flexible seam or hinge, shown in 2A, that mate together to form an assembled surround, shown in 2B.
Figure 2B:
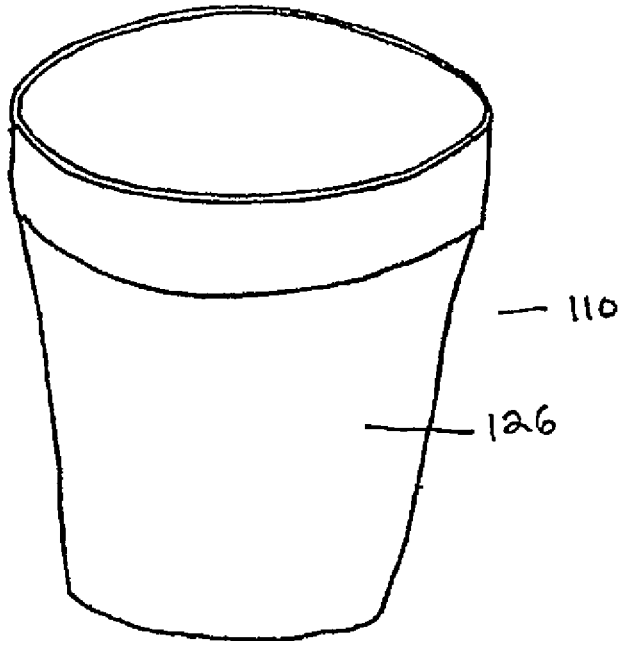

A second embodiment is depicted in FIGS. 2A and 2B. In this embodiment, two shells 218 and 220 each comprising an inner face 122, an outer face 126, and a lip 120 protruding from the lower edge of the inner face of each shell are joined together by a flexible join 216. The two shells are mated together and held in place by hook 214 and eye 212 closures to form an assembled surround 110.

Figure 3A:
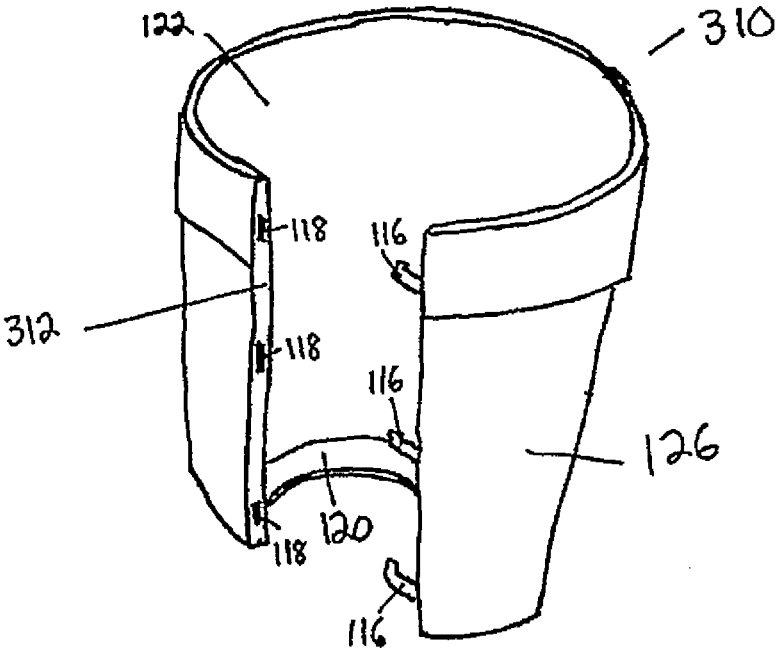
FIGS. 3A and 3B show a perspective view of a third embodiment comprising a single shell, shown in 3A, that mates along its edges to form an assembled surround, shown in 3B.
Figure 3B:
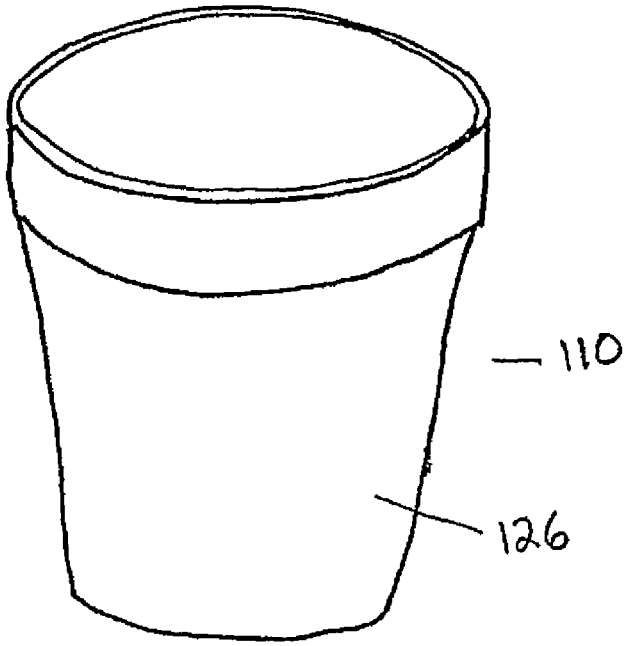

A third embodiment is depicted in FIGS. 3A and 3B. In this embodiment, a single shell 310 comprising an inner face 122, an outer face 126, and a lip 120 protruding from the lower edge of the inner face of the shell, is mated along its vertical edge 312 and held in place by catches 116 that insert into corresponding apertures 118 to form an assembled surround 110.

Figure 4A:
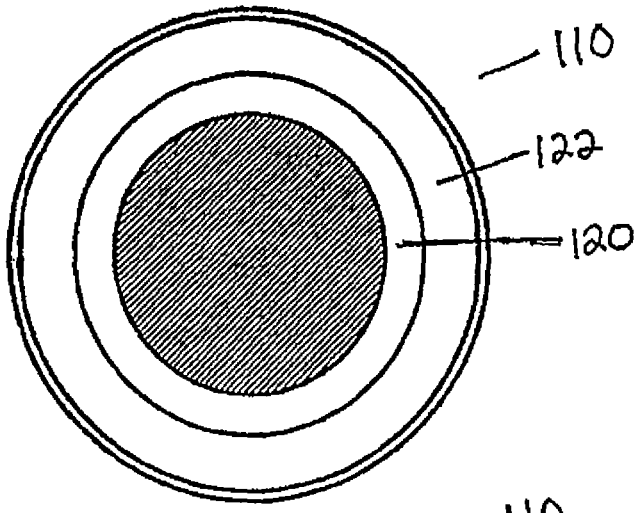
FIGS. 4A, 4B, and 4C show top plan views of different embodiments of an assembled surround.
Figure 4B:
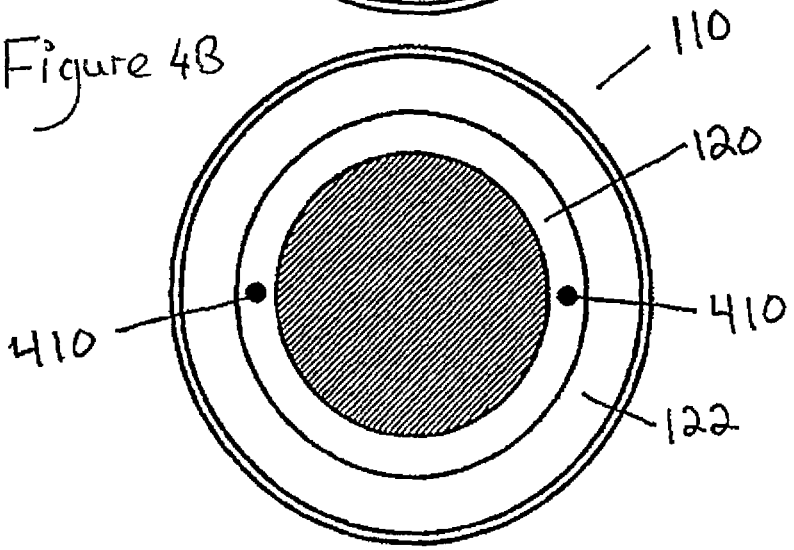
Figure 4C:
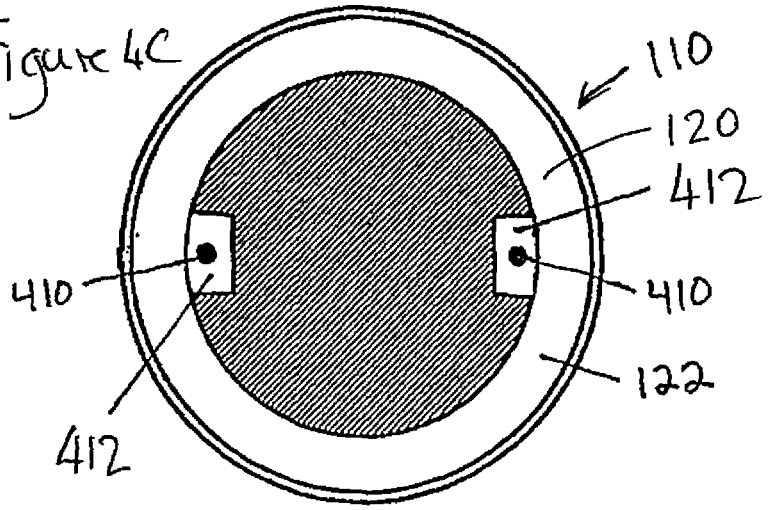

FIGS. 4A, 4B, and 4C depict a top plan view of three embodiments of an assembled surround 110. FIG. 4A depicts an assembled surround 110 with an inner face 122 and a lip 120 that protrudes from the lower edge of inner face of the surround. FIG. 4B depicts an assembled surround 110 with an inner face 122 and a lip 120 that protrudes from the lower edge of inner face of the surround. This lip comprises apertures 410 that are designed to allow the surround to be anchored to a horizontal surface by an anchor member such as a nail, screw, bolt, peg, pin, or spike that passes through the aperture 410. FIG. 4C depicts an assembled surround 110 with an inner face 122 and anchor tabs 412 that protrude from the lower edge of the inner face of the surround. Each anchor tab comprises an aperture 410 designed to allow the surround to be anchored to a horizontal surface by an anchor such as a nail, screw, bolt, peg, or spike that passes through the aperture 410.

While the lip 120 depicted in FIGS. 1 to 4 extends along the full length of the lower edge of each shell 112 and 114 in FIG. 1, 218 and 220 in FIG. 2, 310 in FIG. 3, and the assembled surrounds depicted in FIGS. 4A and 4B; other configurations are possible. For example, the lip may extend along only a portion of the lower edge of one or both shells. In all cases, the lip 120 should be sufficiently narrow to allow the surround to be assembled around an upright structure such as a plant, post, or tree without the lip preventing the surround from being assembled around said upright structure by engaging said upright structure. The lip 120 should further be sufficiently wide to allow a weighted material or an anchor to engage the lip, thereby weighing down or anchoring the surround 110 to a surface at the base of the upright structure around which the surround 110 is assembled. For example, this surface may be the ground, a paving material, a decking material, or a floor. In some embodiments, the width of the lip 120 is no more than about 25% of the inner diameter or inner width of the assembled surround. In further embodiments, the width of the lip 120 is between about 5 to about 25% of the inner diameter or inner width of the assembled surround. In additional embodiments, the lip is no more than about 20%, no more than about 15%, no more than about 10%, or no more than about 5% of the inner diameter or inner width of the assembled surround.

Further, while FIG. 4B depicts two diametrically opposed apertures 410, the lip 120 may comprise a single aperture or a plurality of apertures distributed around its circumference. The aperture or apertures 410 are designed to allow the surround to be anchored to a horizontal surface by at least one anchor member such as a nail, screw, bolt, peg, pin, tee, or spike that passes through an aperture 410. The size and length of anchor member may be selected based on the size of aperture 410 and the size of the ornamental surround. Further, the anchor member may be made of any suitable material, as would be understood by a person skilled in the art. Examples of suitable materials include metal, plastic, and wood. Alternately, an anchor member may engage the edge of the lip without passing through an aperture. For example, an anchor member such as a clamp or clip may be used to secure the lip to a surface beneath the assembled surround. When the surround is anchored by at least one anchor member, the assembled surround may be used without any anchoring material, fill material, or filler material. In another embodiment, at least one anchor member may be used in conjunction with an anchoring material, fill material, and/or filler material.

Additionally, while FIG. 4C depicts an assembled surround 110 with two diametrically opposed lips 120, the surround may comprise a single lip or a plurality of lips distributed around the circumference of the lower edge of the inner face of the surround. Further, the lips 120 may be of any length. Each lip may extend along any portion of the circumference of the lower edge of one or both shells. Additionally, while the lips 120 are shown in FIG. 4C as roughly rectangular, the lips may be of different shapes; such as square, semicircular, or triangular.

Finally, while an anchor material, anchor member, or wedging material may be used to secure or anchor the surround to impede the surround from shifting position, the use of an anchor material, anchor member, or wedging material is optional. In some instances anchoring of the surround may be undesired or unnecessary, in which case the surround may be used in the absence of any anchor material, anchor member, or wedging material.

In a further non-illustrated embodiment, the lip 120 may be absent, providing an assembled surround that has no lip protruding from the lower edge of its inner face. This embodiment is particularly suitable for use when anchoring of the surround is not required, for example when the surround is used in a relatively stable environment such as an indoor environment; when the surround is intended to be anchored by wedging material; or where the surround is made of a relatively heavy material, such as cement, clay, ceramic, metal, composite, or terra cotta.

Figure 5:
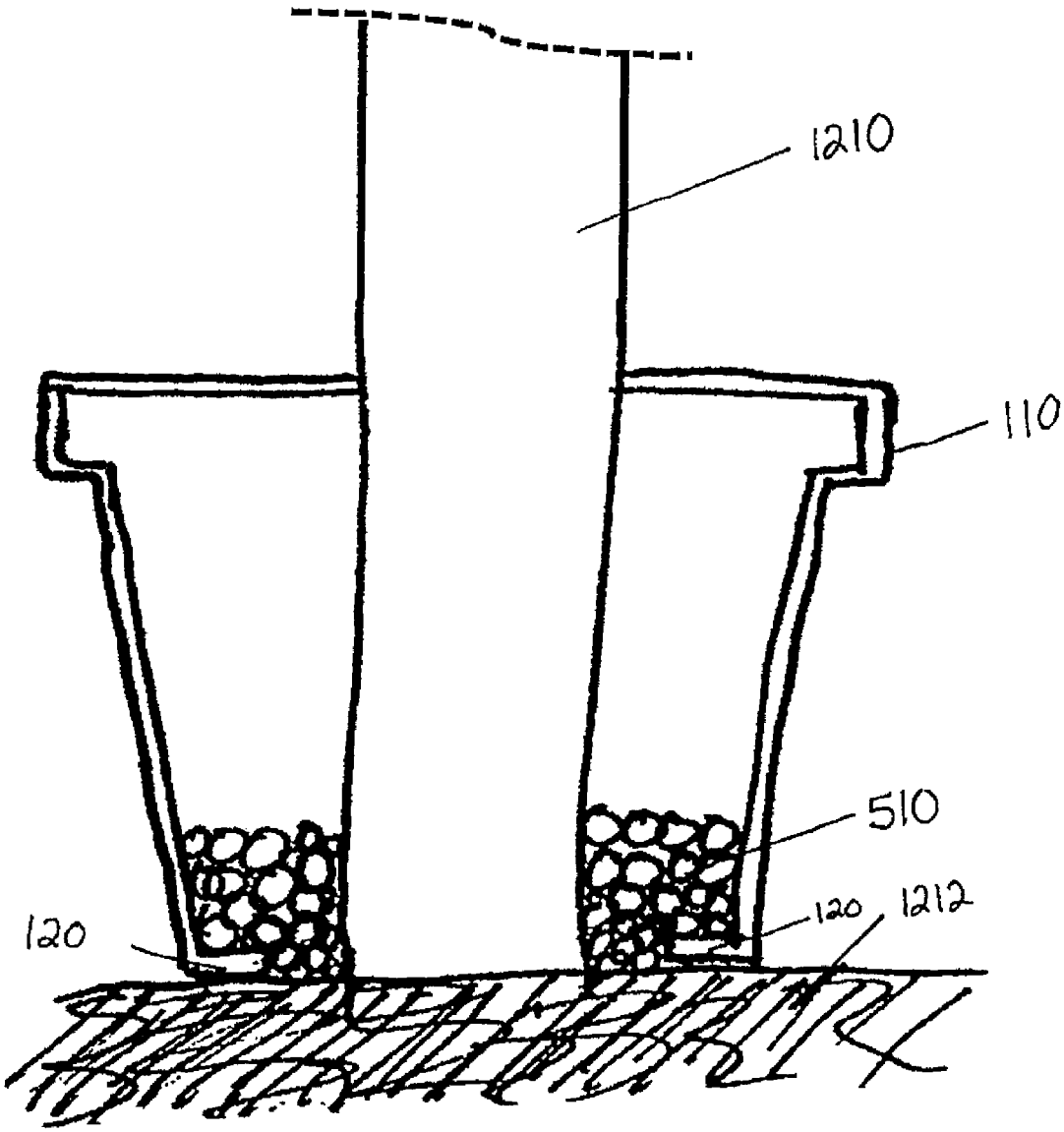
FIG. 5 shows a sectional view of an ornamental surround of the disclosure positioned around the base of a tree and partially filled with anchor material.

In a further non-illustrated embodiment, the ornamental surround is filled with a fill material which may be strictly ornamental or it may be an anchor material that serves to weigh down the surround by engaging the lip or it may be a wedging material that engages the inner face of the surround and the shrub, or any other upright structure such as a post, tree trunk, or pole, to hold the surround in place around the base of the upright structure. Suitable ornamental fill materials include, but are not limited to, straw, mulch, decorative stone, acrylic coloured rocks, glass rocks, marbles, fake or faux rocks, bellani pod balls, natural wood chunks or bark slices, seashells, decorative spheres, wicker & twig balls, and/or plastic/artificial flowers and vines. Further, a layer of decorative material may be used over a layer of filler material, such as foam peanuts, also known as packing peanuts or packing noodles; crumpled or shredded paper; bubble wrap and/or Styrofoam. This reduces the amount of decorative material required and may reduce costs. Suitable anchor materials include stone, glass beads, cement pieces, or landscaping material such as river rock, marble nugget rock, slate chunks, pebbles, rubber mulch, limestone, red shale, and/or rundle rock. Suitable wedging materials include foam, Styrofoam, bubble wrap, plastic bags, rags, and/or shredded or torn materials such as paper or cardboard. Further, mixtures of ornamental materials, FIG. 5 depicts a sectional view of a tree 1210 with an ornamental surround 110 positioned around its base and resting on the surface of ground 1212. The surround is partially filled with fill material 510 that engages the lip 120 of the surround to weigh down, or anchor, the surround to the ground 1212 to prevent the surround from shifting position.

The illustrated embodiments each depict a surround that, when assembled, is substantially cylindrical and tapered towards its base. Further, each illustrated surround comprises only one or two shells. However, the surround may be of different shapes, such as square, rectangular, pentagonal, hexagonal, octagonal, or undulate. The surround may further be tapered or non-tapered. Additionally, the illustrated embodiments each comprise one or two shells in the assembled surround 110, but in other embodiments, three or more shells may be mated to form an assembled surround.

Further, the illustrated embodiments employ catches 116 or hook 214 and eye 212 closures to hold the mated shells together in the assembled surround 110. However, in other embodiments different types of fasteners may be used to hold the assembled surround together. For example, the mated shells may be held together by fasteners such as clips, clasps, catches, binding strips, and/or latches positioned on the inner face, the outer face, and/or the upright edge of at least one shell. In some embodiments, the edges of the ornamental surround may comprise integral fasteners, for example fasteners pre-molded into the surround material that slide and interlock.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments.

Further, while the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting. It will be understood by persons skilled in the art that other variants and modifications may be made without departing from the scope of the invention as defined in the appended claims.

The invention claimed is:

1. A combination comprising:

an upright structure selected from the group consisting of a shrub, tree, post, or pole;

the upright structure being mounted in or on the ground so as to have a portion of the structure at ground level;

and an ornamental surround surrounding the portion of the structure at ground level for improving the appearance of the upright structure at the ground level by making the upright structure appear to be potted, the ornamental surround comprising:

an outer shell having an inner face, an outer face, an upper end and a lower end;

the outer shell being divided longitudinally so as to form a division line extending from the top edge to the bottom edge at which the outer shell is opened to pass around the upright structure with a first edge section on one side of the division line and a second edge section on a second side of the division line;

at least one fastener joining to the first edge section of the shell to the second edge section at the division line to form a complete peripheral shell wall around the upright structure;

wherein the outer shell has sufficient rigidity to be self-supporting;

the outer face of the shell defining a bottom frustoconical wall which extends upwardly and outwardly from the bottom edge to the peripheral top edge parallel to the bottom edge and a top collar surrounding the top edge so as to provide the outward appearance of a plant pot or planter;

the shell defining an open area from the inner surface thereof up to the upstanding structure;

a filler material in the open area that therefore contacts both the upstanding structure on an inside of the filler material and the inner surface on an outside of the filler material;

the shell having at the bottom edge at the ground surface an inwardly extending lip;

the lip being connected at an outer edge of the lip to the bottom edge of the shell around the bottom edge;

the lip having an inner edge of the lip surrounding the upstanding structure and spaced inwardly from the bottom edge and spaced outwardly from the upstanding structure;

the lip being open from the inner edge thereof up to the upstanding structure so as to leave an opening between the upstanding structure and the lip through which material can fall;

and an anchor material on top of the lip that therefore contacts both the upstanding structure on an inside of the anchor material, the inner surface on an outside of the anchor material, a top surface of the lip at a bottom of the anchor material and the ground inwardly of the lip;

the anchor material holding the lip down onto the ground and therefore holding the shell around said portion of the upright structure.

2. The combination of claim 1, wherein the lip comprises one or more apertures and the shell is anchored to the ground surface by at least one anchoring member that is inserted through the aperture and into the ground surface.

3. The combination of claim 1, wherein the shell has a single division and is sufficiently resilient to allow the first and second edge sections of the shell to be spread apart to a distance that is sufficient to allow the spread apart edge sections to be passed around the sides of the upright structure.

4. The combination of claim 1, wherein the shell has a plurality of divisions allowing the shell to be separated into separate parts.

* * * * *